US009362615B2

(12) United States Patent
Cannon et al.

(10) Patent No.: US 9,362,615 B2
(45) Date of Patent: Jun. 7, 2016

(54) MULTI-BANDPASS, DUAL-POLARIZATION RADOME WITH EMBEDDED GRIDDED STRUCTURES

(71) Applicant: Raytheon Company, Waltham, MA (US)

(72) Inventors: Benjamin L. Cannon, Tucson, AZ (US); Jared W. Jordan, Tucson, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 430 days.

(21) Appl. No.: 13/660,471

(22) Filed: Oct. 25, 2012

(65) Prior Publication Data

US 2014/0118217 A1 May 1, 2014

(51) Int. Cl.
*H01Q 1/42* (2006.01)
*H01Q 15/00* (2006.01)

(52) U.S. Cl.
CPC ..... *H01Q 1/425* (2013.01); *H01Q 15/0026* (2013.01)

(58) Field of Classification Search
USPC ..... 343/872
See application file for complete search history.

(56) References Cited

U.S. PATENT DOCUMENTS

| | | | | |
|---|---|---|---|---|
| 3,864,690 | A * | 2/1975 | Pierrot | 343/872 |
| 4,814,785 | A * | 3/1989 | Wu | 343/909 |
| 5,384,575 | A | 1/1995 | Wu | |
| 5,497,169 | A | 3/1996 | Wu | |
| 5,652,631 | A | 7/1997 | Bullen et al. | |
| 5,949,387 | A | 9/1999 | Wu et al. | |
| 6,567,048 | B2 | 5/2003 | McKinzie, III et al. | |
| 6,900,763 | B2 * | 5/2005 | Killen et al. | 343/700 MS |
| 7,071,879 | B2 | 7/2006 | Strickland | |
| 7,084,827 | B1 | 8/2006 | Strange et al. | |
| 7,173,565 | B2 | 2/2007 | Sievenpiper | |
| 7,317,946 | B2 | 1/2008 | Twetan | |
| 7,612,718 | B2 | 11/2009 | Sievenpiper | |
| 7,737,899 | B1 | 6/2010 | McKinzie, III | |
| 7,785,098 | B1 | 8/2010 | Appleby et al. | |
| 7,868,843 | B2 | 1/2011 | Borau et al. | |
| 7,884,766 | B2 | 2/2011 | Haziza | |
| 7,884,778 | B2 | 2/2011 | Wu et al. | |
| 7,889,137 | B2 | 2/2011 | Wu et al. | |
| 8,040,586 | B2 | 10/2011 | Smith et al. | |
| 8,063,833 | B2 | 11/2011 | Sievenpiper | |

(Continued)

FOREIGN PATENT DOCUMENTS

| | | | |
|---|---|---|---|
| WO | 2006024516 | A1 | 3/2006 |
| WO | 2007042938 | A2 | 4/2007 |

(Continued)

OTHER PUBLICATIONS

"Capacitors and Capacitance," John D. Kraus, Electromagnetics, Second Edition, McGraw Hill, 1973.*

(Continued)

*Primary Examiner* — Graham Smith
(74) *Attorney, Agent, or Firm* — Cantor Colburn LLP

(57) ABSTRACT

A radome is provided and includes a dielectric wall and metallic layers embedded within and/or disposed on the monolithic wall. Each of the metallic layers is configured to act as a sub-resonant reactive impedance surface at a lower frequency and as a frequency selective surface at an upper frequency.

12 Claims, 7 Drawing Sheets

(56) References Cited

U.S. PATENT DOCUMENTS

| | | | |
|---|---|---|---|
| 8,081,138 | B2 | 12/2011 | Wu et al. |
| 8,126,410 | B2 | 2/2012 | Alon et al. |
| 2008/0062062 | A1 | 3/2008 | Borau et al. |
| 2010/0097281 | A1 | 4/2010 | Wu et al. |
| 2010/0171675 | A1 | 7/2010 | Borja et al. |
| 2012/0098628 | A1 | 4/2012 | Batchelor et al. |

FOREIGN PATENT DOCUMENTS

| | | | |
|---|---|---|---|
| WO | 2008048210 | A2 | 4/2008 |
| WO | 2010120763 | A2 | 10/2010 |

OTHER PUBLICATIONS

International Search Report for PCT Application No. PCT/US2013/055128, dated Nov. 12, 2013, 5 pages.

Written Opinion for PCT Application No. PCT/US2013/055128, dated Nov. 12, 2013, 5 pages.

Lee et al, "Equivalent-Circuit Models for Frequency-Selective Surfaces at Oblique Angles of Incidence", IEEE Proceedings, vol. 132, Pt. H, No. 6, Oct. 1985, pp. 395-399.

* cited by examiner

MULTI-BANDPASS, DUAL-POLARIZATION RADOME WITH EMBEDDED GRIDDED STRUCTURES

BACKGROUND

The present disclosure relates generally to radomes and, more particularly, to multi-bandpass, dual-polarization radomes.

A radome is an enclosure that protects a device, such as a microwave radar antenna from environmental conditions. The radome is typically constructed of material(s) that are designed to minimally attenuate and distort the electromagnetic signals propagating at the operating frequency or frequencies of the enclosed antenna(s). Radomes can be geodesic, conic, planar, etc., depending upon the particular application and may be ground or aircraft based. In the case of airborne radomes, the outer surface of the radome influences aircraft drag and the radome typically has a sharp-nose shape. The sharp-nose shape of an airborne radome causes electromagnetic signals from the antenna to propagate through the radome at oblique angles of incidence.

Currently, the design of dual-passband radomes with large, non-harmonic band separation presents challenges. In particular, it has been difficult to design high-speed airborne radomes which require transmission at incidence angles in excess of 70 degrees of both transverse electric (TE) and transverse magnetic (TM) polarized energy. When multi-bandpass transmission is desired at non-harmonic frequencies, a conventional monolithic radome cannot be used. Additionally, thermal and environmental requirements can prevent multi-dielectric, layered radomes (e.g. A-sandwich configuration) from being an option.

Previously, attempts to address these concerns have involved the use of inductive metal grids to tune a thin-wall radome. Pierrot, in U.S. Pat. No. 3,864,690, takes advantage of this inductive tuning and presents a multi-bandpass radome concept. Pierrot describes a monolithic radome wall that is physically one half-wavelength thick at an upper frequency F1 and virtually a half-wavelength thick at a lower frequency F2 by embedding an inductive grid into the radome in order to form a resonate passband with the capacitance of the thin, dielectric radome at F2. For large band separation between F2 and F1, however, a large inductance is often required to form a resonant passband at F2. Consequently grid size/spacing must grow in order to synthesize such a large inductance. Pierrot recognized that such a large grid creates grating lobes at F1 due to the repeating lattice dimension of the grid being larger than a free-space wavelength at F1. Pierrot attempted to compensate for such grating lobes by inserting a grid of metal mesh-patches orthogonal to the inductive grid in the same metallization layer.

A different approach to a dual-band radome design is presented by Bullen, et al., in U.S. Pat. No. 5,652,631. Here, the radome wall is tuned to one half-wavelength at a first, higher frequency and a grid array of monopole elements is formed on the surface of the wall to tune the radome to operate at a second lower frequency band. This concept is similar to Pierrot's in that the wall is physically one half-wavelength thick at an upper frequency and virtually a half-wavelength thick at a lower frequency. However, this design requires the antennas at the two frequencies of operation to be orthogonally polarized (e.g., a vertically polarized lower band antenna and a horizontally polarized upper band antenna).

SUMMARY

According to one embodiment, a radome is provided for use with first and second antennas operating at a first, lower frequency and at a second, upper frequency, respectively. The radome includes a dielectric wall and metallic layers embedded within and/or disposed on the dielectric wall. Each of the metallic layers is configured to act as a sub-resonant reactive impedance surface to form a first passband at the first, lower frequency and as a frequency selective surface to form a second passband at the second, upper frequency.

According to another embodiment, a radome is provided and includes a dielectric wall, an inductive metallic grid defining grid apertures embedded in and/or disposed on the dielectric wall and a repeating lattice of metallic structures embedded in and/or disposed on the dielectric wall within the grid apertures. The grid and the metallic structures are tuned simultaneously to permit bandpass transmission at least at upper and lower frequencies and to inhibit generation of grating lobes at least at the upper frequency for incidence angles in excess of 70 degrees.

According to another embodiment, a radome is provided for use with first and second antennas operating at a first, lower frequency and at a second, upper frequency, respectively. The radome includes a dielectric wall and metallic layers embedded within and/or disposed on the dielectric wall and respectively including an inductive metallic grid defining grid apertures and a repeating lattice of metallic structures within the grid apertures. Each of the metallic layers is configured to act as a sub-resonant reactive impedance surface to form a first passband at the first, lower frequency and as a frequency selective surface to form a second passband at the second, upper frequency.

BRIEF DESCRIPTION OF THE SEVERAL VIEWS OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
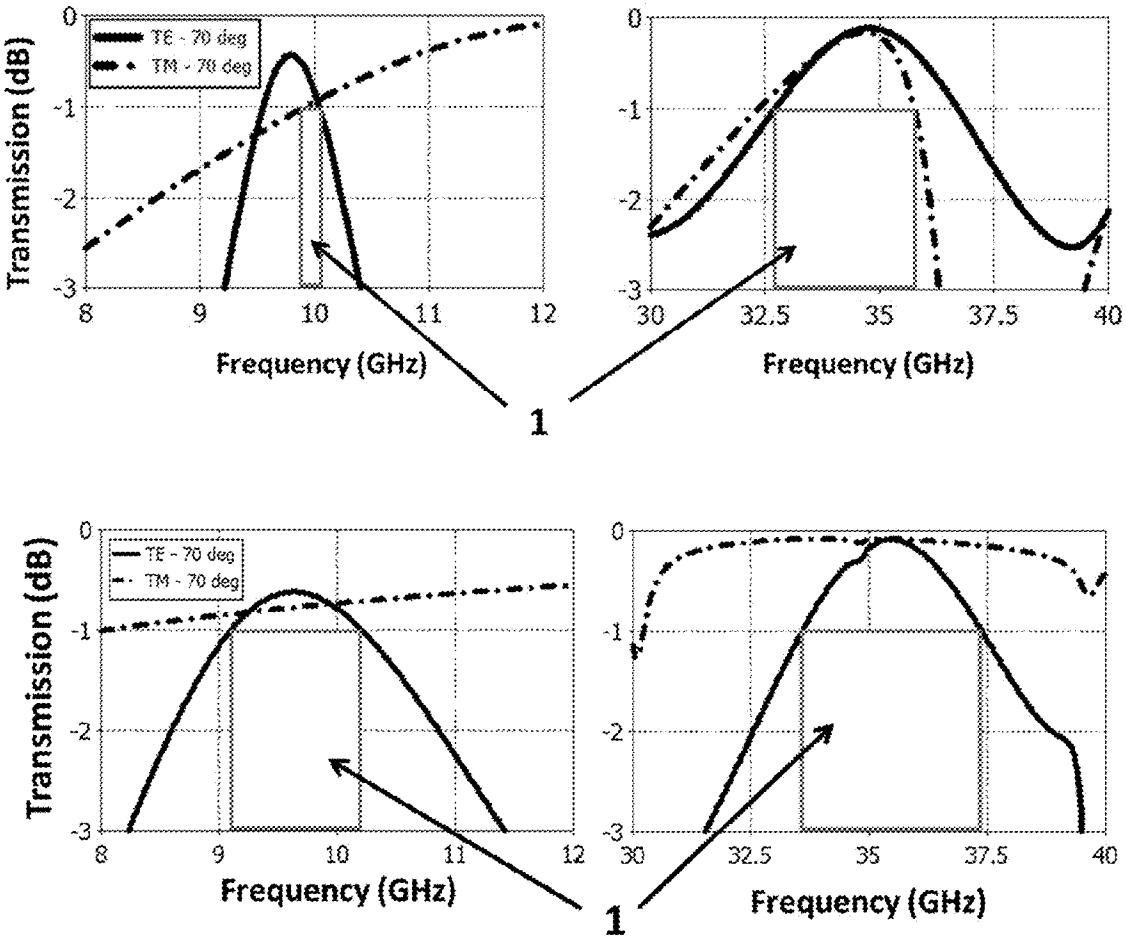
FIG. 1 is a plot of radome wall transmission against frequency for TE and TM polarized energy at about 70 degrees incidence in accordance with embodiments.

The description provided below relates to radome wall configurations implementing metallic gridded structures embedded into or located on the surface of a dielectric radome wall. The metallic gridded structures, in combination with the dielectric radome wall, provide multi-bandpass, dual-polarization transmission capability for large, non-harmonic band separation. The multi-bandpass transmission capability is provided at least at some lower frequency, herein referred to as "F_low" and some higher frequency, herein referred to as "F_high." Transmission capability of equal to or better than −1 dB is provided in excess of 70 degree incidence and up to nearly 90 degree incidence of both transverse electric (TE) and transverse magnetic (TM) polarized energy.

The description provided below also relates to radome wall configurations implementing a metallic compressed grid embedded into or located on the surface of a dielectric radome wall. The metallic compressed grid in combination with the dielectric radome wall provides multi-bandpass, dual-polarization transmission capability for large, non-harmonic band separation. The multi-bandpass transmission capability is provided at least at F_low and F_high. Transmission capability of equal to or better than −1 dB is provided in excess of 70 degree incidence and up to nearly 90 degree incidence of both transverse electric (TE) and transverse magnetic (TM) polarized energy.

In each embodiment, the multi-bandpass transmission is provided at harmonic and non-harmonic frequencies.

The dielectric portion of the radome, which provides environmental protection to the enclosed antenna(s) can be monolithic. This means that constitutive electromagnetic properties of the radome are substantially uniform throughout the radome material. The thickness of the radome is at least initially tuned to be approximately one half wavelength thick at F_high in order to form a transmission passband at F_high. At F_low, the dielectric wall appears like a thin skin wall, meaning that its electrical thickness is less than one half wavelength at F_low, and transmission is consequently poor.

As in Pierrot's disclosure, an inductive metallic grid is embedded into or on the surface of the dielectric wall in an attempt to form a second transmission passband at F_low by allowing the inductance of the metallic grid to resonate with the capacitance of the thin skin wall. However, rather than letting the grid spacing be large enough to achieve a high enough inductance to resonate with the thin wall at F_low, as described by Pierrot, the grid spacing is forced to be smaller than 40% of a free space wavelength at F_high. This ensures that no free-spacing grating lobes exist at F_high for high-incidence-angle transmissions in excess of 70 degrees incidence.

As additionally distinct from Pierrot's disclosure, a repeating lattice of metallic structures is embedded into the centers of the grid apertures such that the metallic structures are capacitively coupled to the metallic grid in order to achieve the necessary inductive reactance to cause resonant bandpass transmission at F_low. Further, the capacitive coupling of the embedded metallic structures to the inductive grid forms a fundamental surface resonance in the metallization layer at some frequency f_o that exists above F_low but typically below F_high. This fundamental surface resonance causes the inductive reactance of the metallic layer to grow to a large enough value to be resonant with the wall at F_low without inducing grating lobes at F_high.

The addition of the metallization into the initial radome wall will detune the transmission performance at F_high and a multi-bandpass radome wall cannot successfully be designed sequentially. Rather, the thickness of the radome wall and the size and geometry of the metallic layer must be iterated or optimized to ensure transmission at both F_low and F_high. Moreover, while many different embedded feature geometries may produce a similar resonant passband at F_low, the geometry may be a sensitive parameter that dictates radome performance at F_high. Said another way, the metallic surface acts as a sub-resonant reactive impedance surface (RIS) at F_low and as a frequency selective surface (FSS) at F_high.

In accordance with embodiments, FIG. 1 demonstrates both the non-harmonic and wide band separation that is achievable between F_low and F_high. Better than −1 dB insertion loss is demonstrated at approximately 10 GHz and 35 GHz for both TE and TM polarized energy at 70 degree incidence angles. The shared bandwidth between the TE and TM polarized energy 1 dictates the dual-polarization radome's better than −1 dB transmission bandwidth.

With reference to FIGS. 2, 3A, 3B and 3C, a radome wall 10 is provided for use with first and second antennas 101, 102 operating at a first, lower frequency (i.e., F_low) and at a second, upper frequency (i.e., F_high), respectively. The radome wall 10 includes a dielectric material 11 and one or more metallic layers 12 embedded within or disposed on the dielectric material 11. The one or more metallic layers 12 include repeating and connected unit cells 130. Each of the unit cells 130 includes an inductive metallic grid 13 and an embedded metallic structure 14. Each of the embedded metallic structures 14 may have anchor-loaded crossed dipole 140 formations (see FIG. 3A), Jerusalem Cross 141 formations (see FIG. 3B) or a loop element 142 formation (see FIG. 3C).

Figure 3A:
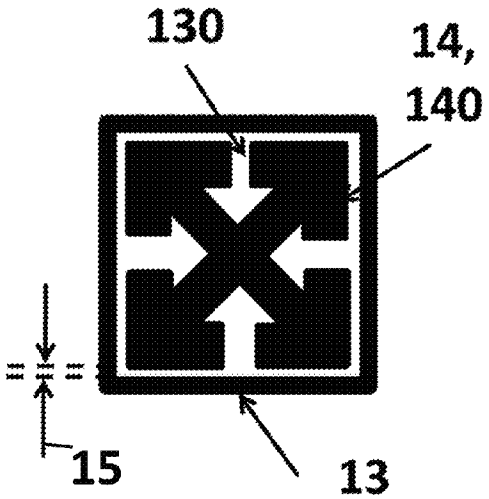
FIG. 3A is a plan view of a portion of the radome wall of FIG. 2 in accordance with alternative embodiments.
Figure 3B:
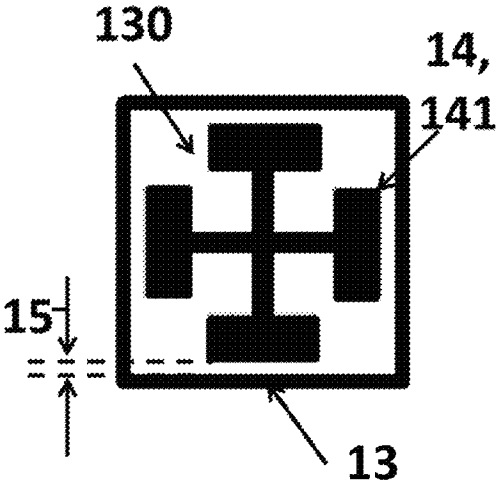
FIG. 3B is a plan view of a portion of the radome wall of FIG. 2 in accordance with alternative embodiments.
Figure 3C:
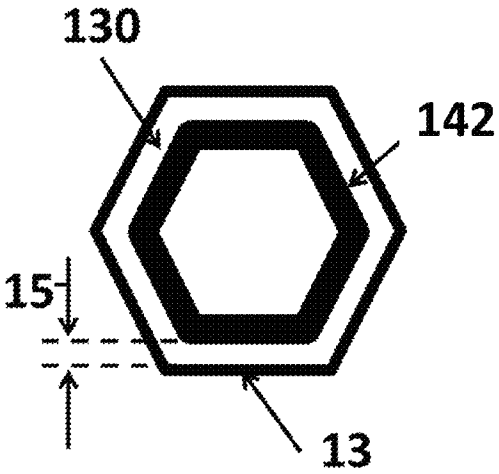
FIG. 3C is a plan view of a portion of the radome wall of FIG. 2 in accordance with alternative embodiments.

FIG. 3C demonstrates that the inductive metallic grid 13 of the unit cells 130 is not restricted to a square lattice shape but can take on various shapes or skews (e.g., the hexagonal shape of FIG. 3C). Furthermore, it should be stated that the configurations of the embedded metallic structures 14 are not limited to the three specific shapes that are shown in FIGS. 3A, 3B and 3C. In addition, where the radome wall 10 has more than one metallic layer 12, the embedded metallic structures 14 in each metallic layer 12 need not be similar to one another. Moreover, the embedded metallic structures 14 in a single metallic layer 12 need not all have the same configuration.

The spacing between adjacent unit cells 130 within the metallic layer 12 is characterized with spacings that are smaller than about 40% of a free space wavelength at F_high. Unit cell spacings smaller than about 40% of a free space wavelength at F_high ensure that free-spacing grating lobes do not exist at F_high and, moreover, that the onset of free-space grating lobes exists above F_high. The metallic grid 13 and the metallic structures 14 are both tuned simultaneously to permit dual band transmission at F_low and F_high.

Figure 4:
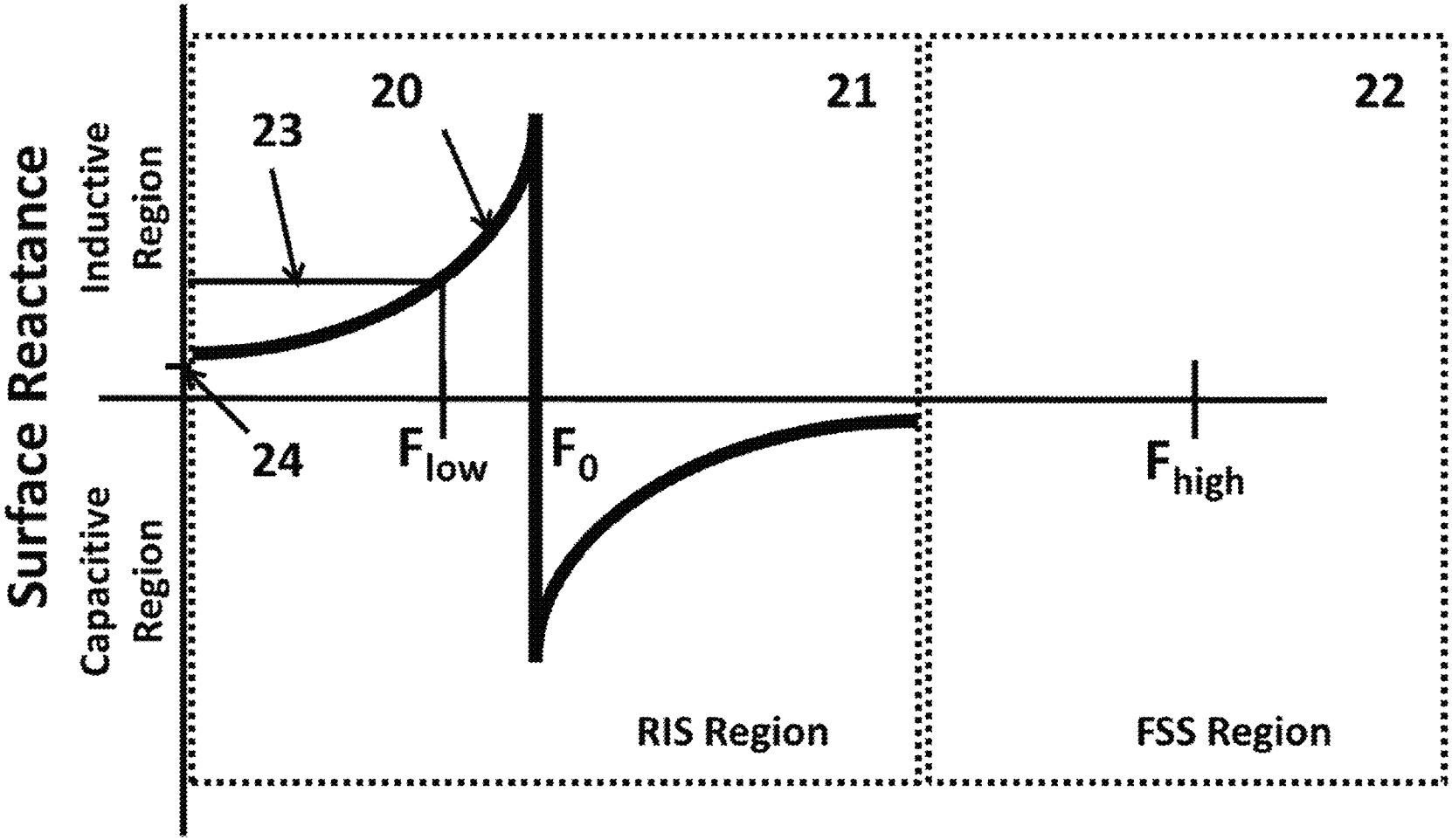
FIG. 4 is a plot of surface reactance of embedded gridded metal structures of the radome wall of FIG. 2 in accordance with embodiments.

By restricting the unit cell size to avoid free-space grating lobes, there does not exist a high enough inductive reactance at F_low from the metallic grid 13 alone, such as used by Pierrot. FIG. 4 demonstrates how the capacitive coupling of the embedded metallic structures 14 to the inductive grid 13 can achieve the necessary inductive reactance at F_low. As shown, the surface reactance 20 of the one or more metallic layers 12 is plotted against frequency in the RIS region 21. For simplicity, the surface reactance 20 is not plotted in the region where the surface behaves as an FSS 22. For frequencies below F_low, the inductive reactance of the surface is lower than the necessary value 23 to achieve a transmission passband at F_low. The asymptotic behavior of the surface reactance 20 to a finite inductive value 24 that is lower than the necessary value 23 is because the grid inductance alone dominates the surface reactance at low frequencies. To increase this inductive reactance to the necessary value 23 at F_low, capacitive coupling of the center metallic structure 14 to the inductive grid 13 is controlled via the gap 15 (see FIGS.

3A, 3B and 3C) between the metallic grid 13 and the embedded metallic structure 14 and by the geometry of the embedded metallic structure 14.

By capacitively coupling the metallic grid 13 and the embedded metallic structure 14, a fundamental surface resonance is formed at some frequency F_o, which exists above F_low but typically below F_high. This fundamental surface resonance at F_o causes the inductive reactance of the metallic layer 12 to grow to a large enough value at F_low to resonant with the electrically thin dielectric material 11 without inducing free-space grating lobes at F_high.

Though not shown, for frequencies in region 22, higher order resonances above the fundamental resonance F_o begin to form. As frequency increases, the size of the unit cell 130 becomes larger compared to a wavelength. In this region, maintaining a resonant passband for both TE and TM polarized energy at F_high can be very sensitive to the geometry and size of the metallic grid 13 and the embedded metallic structure 14. The geometry of the metallic layer 12 is then iterated or optimized with the dielectric material 11 to achieve passbands at both F_low and F_high for both TE and TM polarized energy. Thus, multi-bandpass, dual-polarization transmission is achieved for non-harmonic frequencies with, in some cases, very wide band separation.

In accordance with alternative aspects and, as similarly distinct from Pierrot's disclosure, a compressed grid is introduced to achieve the necessary inductive reactance to create a resonant passband at F_low in a smaller, more compact area than a conventional straight-wire grid. The compressed inductive grid forms a fundamental surface resonance, with its distributed self-capacitance, in the metallization layer at some frequency f_o that exists above F_low but typically below F_high.

The compressed grid allows for, but is not limited to, three modes of operation at F_low. Firstly, the arms of the grid can be compressed just enough to increase the equivalent inductance to the necessary value needed to resonate with the dielectric radome wall, while taking care to minimize the distributed self-capacitance of the compressed grid. This allows for maximum bandwidth at F_low. Secondly, the unit cell size can be further reduced by compressing the grid more than was the case in the first mode of operation and the distributed self-capacitance of the compressed grid can be utilized to create the same inductive reactance at F_low. This pushes the onset of grating lobes to a higher frequency and allows for a larger band separation between F_low and F_high. Thirdly, the unit cell size can be kept the same as was the case in the first mode of operation, the grid can be compressed more and the distributed self-capacitance of the compressed grid can be utilized to create an even larger inductive reactance at F_low. This allows for the tuning of radome walls requiring a larger inductive reactance.

The addition of the compressed grid metallization into the radome wall will detune the transmission performance at F_high, and a multi-bandpass radome wall cannot successfully be designed sequentially. Rather, the thickness of the radome wall and the size and geometry of the metallic layer must be iterated or optimized to ensure transmission at both F_low and F_high. Moreover, while many different compressed grid geometries may produce a similar resonant passband at F_low, the geometry may be a sensitive parameter that dictates radome performance at F_high. Said another way, the metallic surface acts as an RIS at F_low and as an FSS at F_high.

Figure 2:
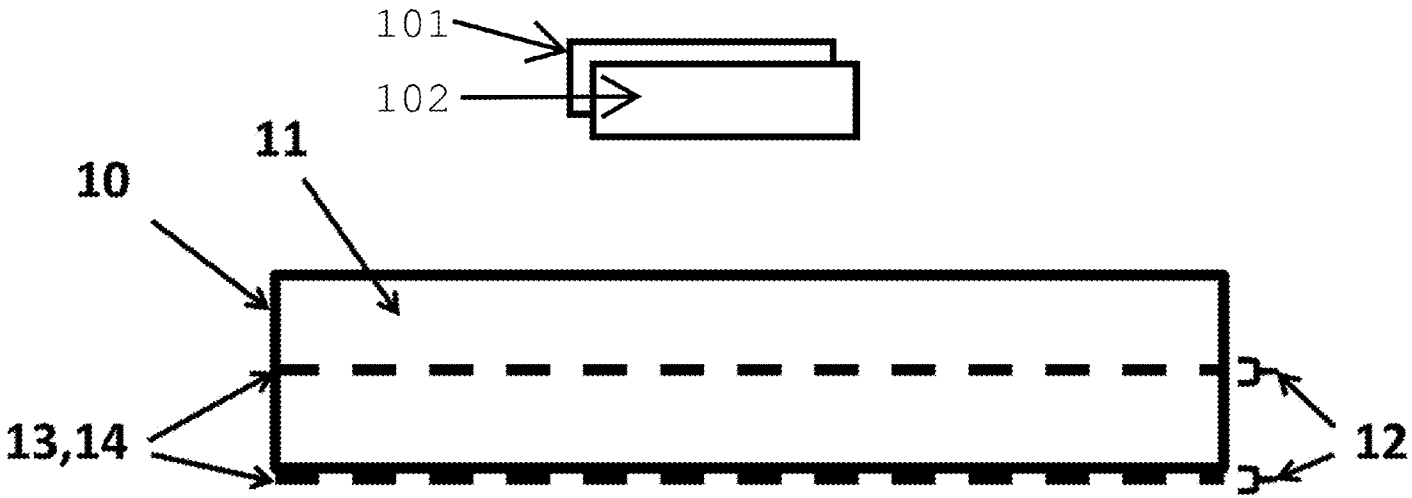
FIG. 2 is a side view of a radome wall in accordance with embodiments.
Figure 5B:
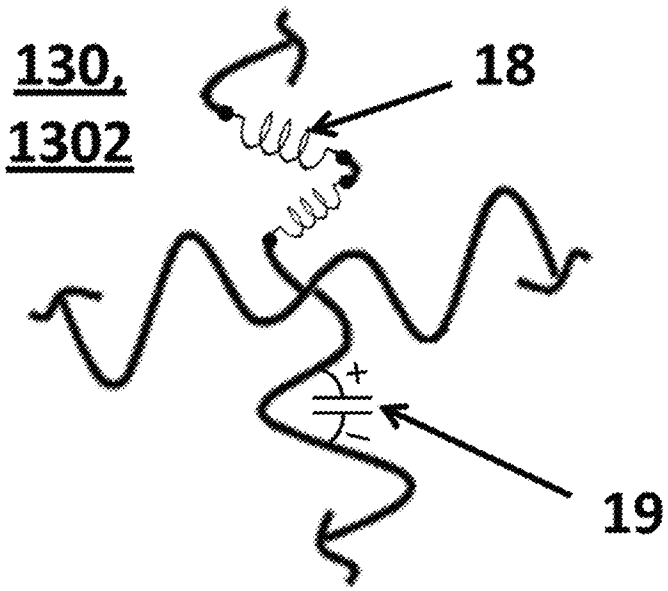
FIG. 5B is a plan view of a portion of the radome wall of FIG. 2 in accordance with alternative embodiments.
Figure 5A:
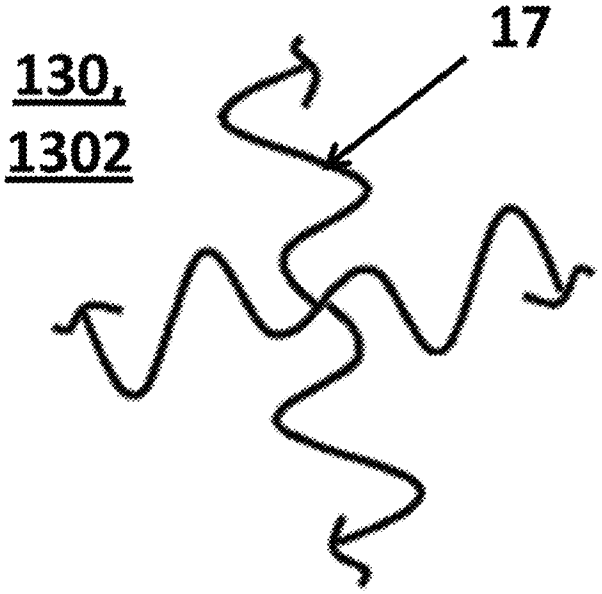
FIG. 5A is a plan view of a portion of the radome wall of FIG. 2 in accordance with alternative embodiments.

With reference to FIGS. 2, 5A and 5B, the radome wall 10 is provided as described above and it is not necessary to repeat the description provided above. As shown in FIGS. 5A and 5B, the one or more metallic layers 12 may include repeating connected unit cells 130 and an example of a unit cell 130 is, but is not limited to, the compressed grid 1302 illustrated in FIG. 5A. The compressed grid 1302 includes connected compressed grid arms 17. FIG. 5B provides a first-order equivalent structure with a distributed circuit model for the grid inductance 18 and the distributed self-capacitance 19.

The shape of the compressed grid arms 17 may be, but is not limited to, a damped sinusoidal function to increase the grid inductance 18 and control the distributed self-capacitance 19 of the compressed grid 1302. Furthermore, as noted above, the grid is not restricted to a square lattice, but can rather take on various shapes or skews (e.g. the hexagonal shape noted above).

The spacing between adjacent unit cells 130 within metallic layer 12 is characterized with spacings that are smaller than about 40% of a free space wavelength at F_high. Unit cell spacings smaller than about 40% of a free space wavelength at F_high ensure that free-spacing grating lobes do not exist at F_high and, moreover, that the onset of free-space grating lobes exists above F_high. The compressed grid 1302 is tuned to permit dual band transmission at F_low and F_high.

By restricting the unit cell size to avoid free-space grating lobes, there does not exist a high enough inductive reactance at F_low from a straight metallic grid alone, such as used by Pierrot. With the use of the compressed grid 1302 within the one or more metallic layers 12, free-space grating lobes can be avoided and a large enough inductive reactance can be created.

Figure 6:
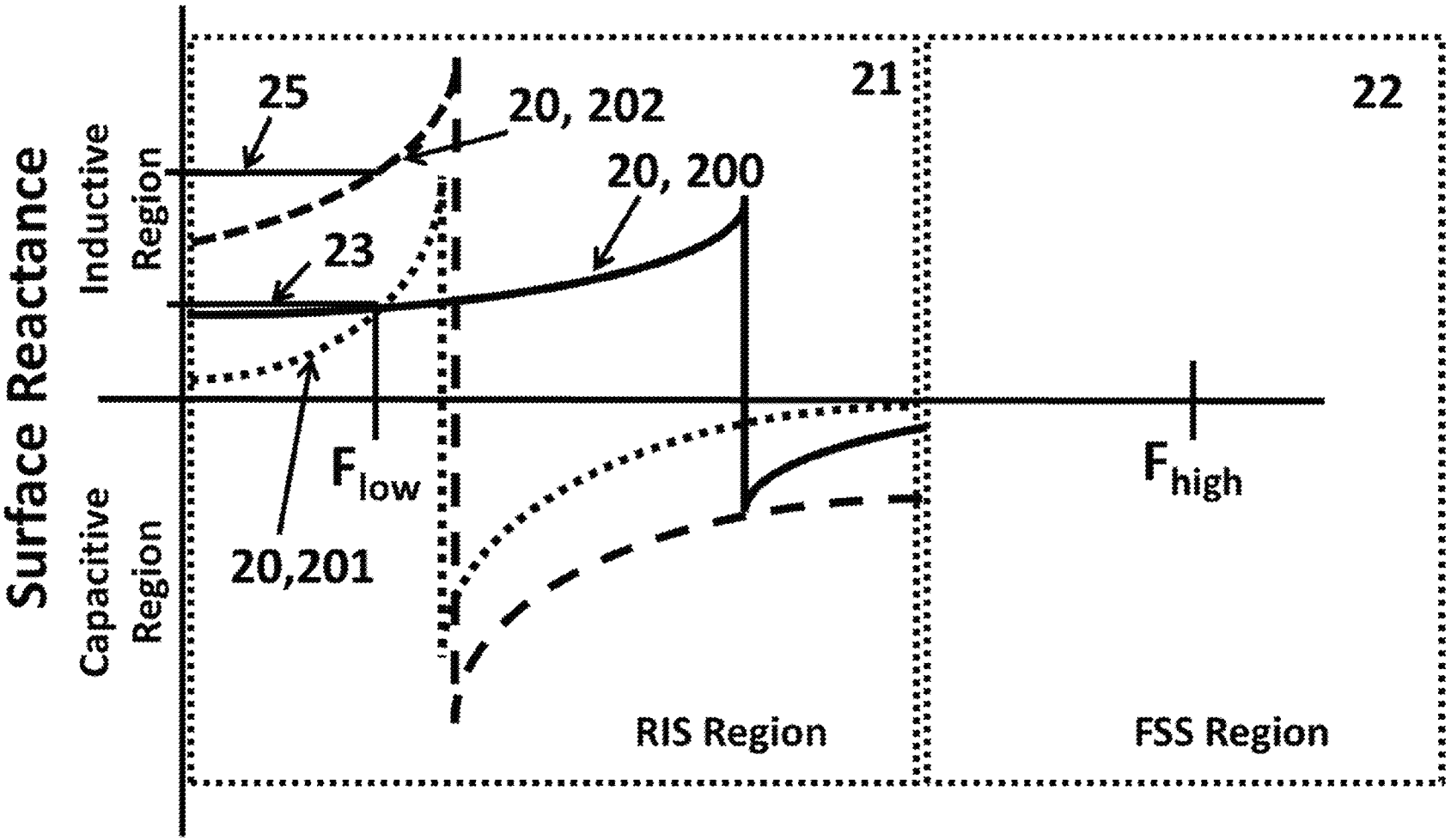
FIG. 6 is a plot of surface reactance of a compressed grid layer of the radome wall of FIG. 2 in accordance with embodiments.

With reference to FIG. 6, the surface reactance 20 of the metallic layer 12 is plotted against frequency in the RIS region 21. For simplicity, the surface reactance 20 is not plotted in the region where the surface behaves as an FSS 22. The compressed grid 1302 allows for, but is not limited to, three modes of operation for tuning the radome wall (see FIG. 2) at F_low. Firstly, the compressed grid arms 17 can be compressed just enough to increase the equivalent inductance to the necessary value 23 needed to resonate with the dielectric material 11 at F_low, while minimizing distributed self-capacitance 19 (see FIG. 5B). This produces the surface reactance curve 200 and allows for maximum bandwidth at F_low. Secondly, the unit cell size can be further reduced by compressing the grid more and utilizing the distributed self-capacitance 19 to create the same inductive reactance necessary value 23 at F_low. This produces the surface reactance curve 201, which pushes the onset of grating lobes to a higher frequency and allows for a larger band separation between F_low and F_high. Thirdly, the unit cell size can be kept the same as the first mode of operation, and the grid is compressed more and the distributed self-capacitance 19 is utilized to create an even larger inductive reactance 25 at F_low. This produces the surface reactance curve 202, which allows for the tuning of radome walls requiring a larger inductive reactance.

The compressed grid 1302 achieves increased grid inductance 18 over a conventional straight-wire grid by meandering more continuous trace length into a smaller unit cell area. Furthermore, this meandering creates a distributed self-capacitance 19 along the compressed grid arms 17. This forms a fundamental surface resonance between the continuous trace inductance 18 and the controlled distributed self-capacitance 19 at some frequency F_o which exists above F_low but typically below F_high. This fundamental surface resonance at F_o causes the inductive reactance of the metallic layer 12 to grow to a larger value at F_low.

Though not shown, for frequencies in region 22 higher order resonances above the fundamental resonance F_o begin to form. As frequency increases, the size of the unit cell 130 becomes larger compared to a wavelength. In this region, maintaining a resonant passband for both TE and TM polarized energy at F_high can be very sensitive to the geometry and size of the unit cell 130. The geometry of the metallic layer 12 is then iterated or optimized with the dielectric material 11 to achieve passbands at both F_low and F_high for both TE and TM polarized energy. Thus, multi-bandpass, dual-polarization transmission is achieved for non-harmonic frequencies with, in some cases, very wide band separation.

Figure 7:
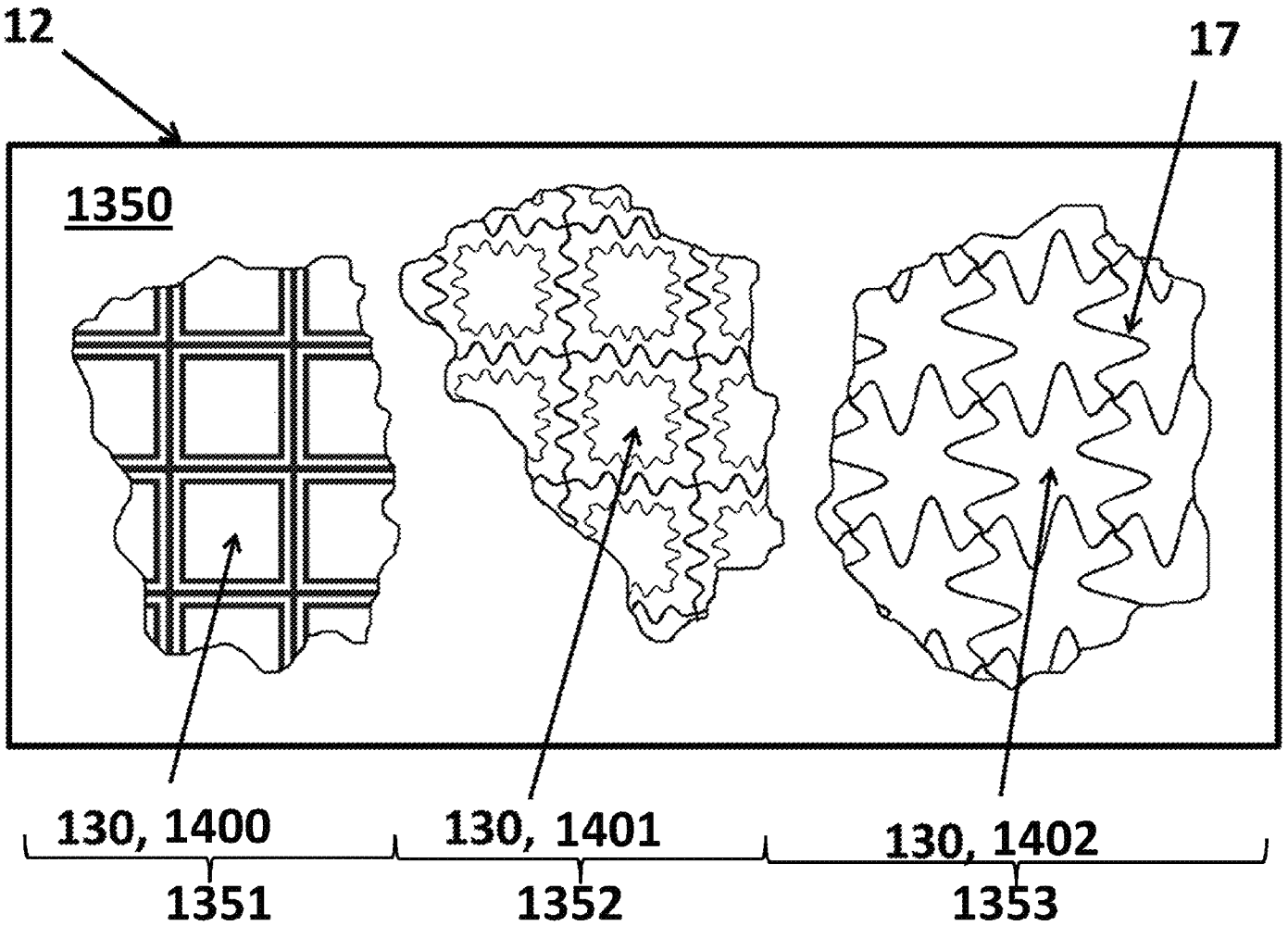
FIG. 7 is a plan view of a hybridized radome in accordance with further embodiments.

With reference to FIG. 7, a hybridized radome 1350 is provided and includes a first portion 1351, a second portion 1352 and a third portion 1353. The one or more metallic layers 12 may be disposed within and/or on each of the first, second and third portions 1351, 1352 and 1353 as first, second or third metallic layers 12 and include a combination of different unit cells 130 as described above. For example, in the first portion 1351, the unit cells 130 may include a gridded loop 1400, in the second portion 1352, the unit cells 130 may include a compressed gridded square loop 1401 and, in the third portion 1353, the unit cells 130 may include a compressed grid 1402. In each case, the one or more metallic layers 12 are tuned to perform as a reactive impedance sheet at F_low and as a frequency selective surface at F_high.

The compressed embedded gridded structure, such as, but not limited to, the compressed gridded square loop 1401, is utilized to obtain the same necessary value 23 of inductive reactance (see FIG. 4) as a conventional embedded gridded structure but in a smaller area. This pushes the onset of grating lobes to an even higher frequency, allowing for a larger band separation between F_low and F_high. The compressed grid 1402 is utilized to obtain the same necessary value 23 of inductive reactance (see FIG. 4) while minimizing the distributed self-capacitance along the compressed grid. The increase in the finite inductive value 24 (see FIG. 4) of the compressed grid 1402 alone and the reduction of the distributed self-capacitance along the compressed grid 1402 allows for increased bandwidth at F_low. The shape of the compressed grid arms 17 is, but not limited to, a damped sinusoidal function to control the distributed self-capacitance along the compressed grid 1402. Furthermore, it should be stated that the unit cells 130 are not limited to the three specific shapes shown in FIG. 7.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the embodiments in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A radome, comprising:

a dielectric wall;

an inductive metallic grid defining grid apertures embedded in and/or disposed on the dielectric wall; and a repeating lattice of metallic structures embedded in and/or disposed on the dielectric wall within the grid apertures;

the grid apertures and the metallic structures being provided in a 1:1 singularly discrete metallic structure-to-grid aperture configuration with each grid aperture and each corresponding metallic structure having different shapes, and the grid being tuned simultaneously to permit bandpass transmission at least at upper and lower frequencies and to inhibit generation of grating lobes at least at the upper frequency for incidence angles in excess of 70 degrees, wherein the grid is characterized with a grid spacing smaller than 40% of a free space wavelength at the upper frequency.

2. The radome according to claim 1, wherein a thickness of the dielectric wall is less than one half wavelength at the lower frequency.

3. The radome according to claim 1, wherein the metallic structures are capacitively coupled with the grid to thereby achieve an inductive reactance necessary to cause the bandpass transmission at the lower frequency.

4. The radome according to claim 1, wherein the grid and the metallic structures are tuned to permit bandpass transmission at the upper frequency while maintaining bandpass transmission at the lower frequency.

5. The radome according to claim 1, wherein the grid apertures are one of rectangular and hexagonal and arranged in a repeating matrix.

6. The radome according to claim 1, wherein:

the metallic structures comprise singular anchor-loaded crossed dipole formations that are respectively embedded in and/or disposed on the dielectric wall within each of the grid apertures, and the metallic grid and the metallic structures comprise respective axes, which are transversely oriented relative to one another.

7. A radome for use with first and second antennas operating at a first, lower frequency and at a second, upper frequency, respectively, the radome comprising:

a dielectric wall; and metallic layers embedded within and/or disposed on the dielectric wall and respectively including an inductive metallic grid defining grid apertures and a repeating lattice of metallic structures within the grid apertures;

each of the metallic layers being configured to act as a sub-resonant reactive impedance surface to form a first passband at the first, lower frequency and as a frequency selective surface to form a second passband at the second, upper frequency, wherein the grid is characterized with a grid spacing smaller than 40% of a free space wavelength at the second, upper frequency, and the grid apertures and the metallic structures are provided in a 1:1 singularly discrete metallic structure-to-grid aperture configuration with each grid aperture and each corresponding metallic structure having different shapes.

8. The radome according to claim 7, wherein a thickness of the dielectric wall is less than one half wavelength at the lower frequency.

9. The radome according to claim 7, wherein the metallic structures are capacitively coupled with the grid to thereby achieve an inductive reactance necessary to cause bandpass transmission at the lower frequency.

10. The radome according to claim 7, wherein the grid and the metallic structures are tuned to permit bandpass transmission at the upper frequency while maintaining bandpass transmission at the lower frequency.

11. A radome, comprising:

a dielectric wall;

an inductive metallic grid continuously defining grid apertures embedded in and/or disposed on the dielectric wall; and a repeating lattice of metallic structures embedded in and/or disposed on the dielectric wall within the grid apertures;

the grid and the metallic structures being tuned simultaneously to permit bandpass transmission at least at upper and lower frequencies and to inhibit generation of grating lobes at least at the upper frequency for incidence angles in excess of 70 degrees, wherein:

the grid is characterized with a grid spacing smaller than 40% of a free space wavelength at the upper frequency, the grid apertures and the metallic structures are provided in a 1:1 singularly discrete metallic structure-to-grid aperture configuration, and the grid apertures are hexagonal and arranged in a repeating matrix and the metallic structures are singular hexagonal loop element formations respectively within each of the grid apertures.

12. The radome according to claim 7, wherein:

the metallic structures comprise singular anchor-loaded crossed dipole formations that are respectively embedded in and/or disposed on the dielectric wall within each of the grid apertures, and the metallic grid and the metallic structures comprise respective axes, which are transversely oriented relative to one another.

* * * * *